US007481970B2

(12) United States Patent
Toji et al.

(10) Patent No.: US 7,481,970 B2
(45) Date of Patent: Jan. 27, 2009

(54) HEAT RESISTANT ALLOY FOR USE AS MATERIAL OF ENGINE VALVE

(75) Inventors: Akihiro Toji, Yasugi (JP); Toshihiro Uehara, Yonago (JP); Katsuhiko Tominaga, Wako (JP); Shoichi Nakaya, Wako (JP); Katsuaki Sato, Wako (JP)

(73) Assignees: Hitachi Metals, Ltd., Tokyo (JP); Honda Motor Co., Ltd., Tokyo (JP)

( * ) Notice: Subject to any disclaimer, the term of this patent is extended or adjusted under 35 U.S.C. 154(b) by 284 days.

(21) Appl. No.: 11/134,329

(22) Filed: May 23, 2005

(65) Prior Publication Data

US 2005/0265887 A1 Dec. 1, 2005

(30) Foreign Application Priority Data

May 26, 2004 (JP) ..... 2004-155518

(51) Int. Cl.
*C22C 19/051* (2006.01)

(52) U.S. Cl. ..... 420/448; 148/428

(58) Field of Classification Search ..... 420/448; 148/410, 448, 555, 556, 428
See application file for complete search history.

(56) References Cited

U.S. PATENT DOCUMENTS 3,926,568 A * 12/1975 Benjamin et al. ..... 75/230
4,128,419 A * 12/1978 Terekhov et al. ..... 420/448
4,231,795 A * 11/1980 Gibson et al. ..... 420/448
4,871,512 A * 10/1989 Takagi et al. ..... 420/448
6,132,527 A * 10/2000 Hessell et al. ..... 148/410

FOREIGN PATENT DOCUMENTS

JP 7-109539 A2 4/1995
JP 7-216482 A2 8/1995
JP 7-332035 A2 12/1995
JP 9-279309 A2 10/1997
JP 11-229059 A2 8/1999

* cited by examiner

*Primary Examiner*—Deborah Yee
(74) *Attorney, Agent, or Firm*—Westerman, Hattori, Daniels & Adrian, LLP.

(57) ABSTRACT

A low cost, economical and less resource-consuming heat resistant alloy for use as material of engine valve is disclosed, while the alloy has excellent mechanical properties at high temperature and excellent toughness after heated for a long time that conventional heat resistant alloys have not had. The alloy consists essentially of, in mass percent, C of 0.01 to 0.15%, Si of 0.01 to 0.8%, Mn of 0.01 to 0.8, Cr of 14 to 17%, Mo of more than 3.0% but equal to or less than 5.0%, Al of 1.6 to 2.5%, Ti of 1.5 to 3.0%, Nb or Nb+Ta of 0.5 to 2.0%, Ni of 50 to 60%, B of 0.001 to 0.015%, at least one of Mg of 0.001 to 0.015% and Ca of 0.001 to 0.015%, and the balance being Fe, wherein value A defined by 0.293[Ni]−0.513[Cr]−1.814[Mo] is 2.0 to 5.8, value B defined by [Al]/([Al]+[Ti]+[Nb]+[Ta]) is 0.45 to 0.65, and value C defined by [Al]+[Ti]+[Nb]+[Ta] is 6.2 to 7.6, wherein brackets mean atomic % of each element in the alloy.

6 Claims, 1 Drawing Sheet

50 μm

HEAT RESISTANT ALLOY FOR USE AS MATERIAL OF ENGINE VALVE

BACKGROUND OF THE INVENTION

1. Field of the Invention

The present invention relates to a heat resistant alloy for use as a material of engine valves mainly used in exhaust engine valves in automobiles.

2. Description of the Related Art

Conventionally, a Fe-based alloy (heat resistant steel) such as SUH11 and SUH35 has been widely used for automotive engine valves, but NCF751 (Ni-15.5Cr-1Nb-2.3Ti-1.2Al-7Fe in mass percent) of a Ni-base superalloy has been used in accordance with an increase of the use temperature.

However, NCF751 is more expensive than the Fe-based alloy because NCF751 includes a Ni content as high as about 70%. For this reason, a resource-saving type alloy having high-temperature strength and structural stability after a long-time exposure at high temperature, close to those of NCF751, has been developed. As a result, for instance, a Fe-based heat-resistant alloy of which the Ni content is decreased to 30 to 35 mass %, is disclosed in Japanese Laid Open Patent JP H09-279309-A2, a Fe-based heat-resistant alloy of which the Ni content is decreased to 30 to 49 mass %, in JP H07-109539-A2, and a Fe-based heat-resistant alloy of which the Ni content is decreased to 35 to 45 mass %, in JP H07-332035-A2. In addition, high-Ni heat-resistant alloys having more excellent high-temperature strength than NCF751 are disclosed in JP H07-216482-A2, JP H11-229059-A2 and others.

In recent years, against the background of global environmental problems, a more improved high-temperature strength which even NCF751 can not satisfy has been partly required for a valve material for the purpose of further increasing an efficiency of an engine. On the other hand, the resource saving and cost reduction of a component are expected for strengthening cost competitiveness in a globalized market.

The above-described alloys disclosed in JP H09-279309-A2, JP H07-109539-A2 and JP H07-332035-A2 contain 49 mass % or less Ni, so that they are excellent in terms of resource saving and cost reduction, but do not have more excellent high-temperature strength than NCF751. In addition, an alloy disclosed in JP H07-216482-A2 has more excellent high-temperature strength than NCF751 has, but is practically considered as an alloy containing more than 60 mass % Ni, so that it is insufficient in the respect of resource saving and cost reduction.

An alloy disclosed in JP H11-229059-A2 proposed by one of the present applicants, which has excellent high-temperature strength and a low cost at the same time, which has not been achieved in a conventional alloy, contains 50 to 60 mass % Ni and has a lower cost and more excellent high-temperature strength than NCF751 has. However, it was elucidated that the alloy has insufficient structural stability at a high temperature, and consequently has the possibility of decreasing toughness by being heated for a long time when used as a valve.

SUMMARY OF THE INVENTION

An object of the present invention is to provide a resource-saving heat-resistant alloy for use as a material of an engine valve, which has both high-temperature strength and excellent toughness after a long-time exposure at high temperature, which has not been achieved by the above-described heat-resistant alloys, and is inexpensive and economical.

First of all, the present inventors have investigated in detail an alloy disclosed in JP H11-229059-A2, in order to improve the defect of the alloy, which has insufficient structural stability at a high temperature and lowers toughness by being heated for a long time. As a result, they have found that the alloy has excellent high-temperature strength not less than NCF751 has, but actually contains more than 17 mass % Cr, and the Cr content is too high with respect to a Ni content, and Mo and W contents of solution-strengthening elements for keeping structural stability, so that the excessive Cr content leads to the formation of an embrittling phase such as a σ-phase or an α'-phase after a long-time exposure at high temperature, and consequently to the remarkable lowering of toughness. As a result of extensive research for keeping the toughness after a long-time exposure at high temperature to a high level, the present inventors have found that a heat resistant alloy having extremely high structural stability, excellent toughness after a long-time exposure at high temperature, and higher high-temperature strength than NCF751 can be obtained by controlling simultaneously the contents of Cr and Ni of elements constituting austenite, and Mo of a solution-strengthening element, into a more suitable range, and achieved the present invention.

Therefore, a heat resistant alloy for use as material of engine valve according to the invention consists essentially of, in mass percent, C of 0.01 to 0.15%, Si of 0.01 to 0.8%, Mn of 0.01 to 0.8%, Cr of 14 to 17%, Mo of more than 3.0% but equal to or less than 5.0%, Al of 1.6 to 2.5%, Ti of 1.5 to 3.0%, Nb or Nb+Ta of 0.5 to 2.0%, Ni of 50 to 60%, B of 0.001 to 0.015%, at least one of Mg of 0.001 to 0.015% and Ca of 0.001 to 0.015%, and the balance being Fe. In the heat resistant alloy, value A defined by 0.293[Ni]−0.513[Cr]−1.814[Mo] is 2.0 to 5.8, value B defined by [Al]/([Al]+[Ti]+[Nb]+[Ta]) is 0.45 to 0.65, and value C defined by [Al]+[Ti]+[Nb]+[Ta] is 6.2 to 7.6, wherein brackets mean atomic % of each element in the heat resistant alloy.

In the above-mentioned heat resistant alloy for use as material of engine valve according to the invention, it is desirable that Mo content is 3.5 to 4.0 mass %, value A is 2.4 to 4.0, value B is 0.5 to 0.6 and value C is 6.4 to 7.0.

It is preferable that a ratio of maximum Cr content to minimum Cr content is equal to or less than 1.2 when a line analysis of Cr segregation is performed on a cross section of the heat resistant alloy for use as material of engine valve.

It is preferable that the heat resistant alloy for use as material of engine valve according to the invention shows 2 mm U notch Charpy impact strength equal to or more than 50 J/cm$^2$ at room temperature after heated at 800° C. for 400 hours.

It is more preferable that intermetallic compound grains of σ-phase, α'-phase, η-phase or δ-phase of equal to or longer than 3 μm do not precipitate in a microscopic structure of the heat resistant alloy after heated at 800° C. for 400 hours.

A heat resistant alloy for use as a material of an engine valve according to the present invention has high-temperature strength and excellent toughness after a long-time exposure at high temperature, which has not been achieved by a conventional heat resistant alloy, has a resource-saving property and a cost-reducing property, and is economically advantageous, so that the alloy can realize a higher efficiency of an engine, save resources, and lower the cost of the valve material, when used as an engine valve material requiring high strength.

DETAILED DESCRIPTION OF THE PREFERRED EMBODIMENTS

Figure 1:
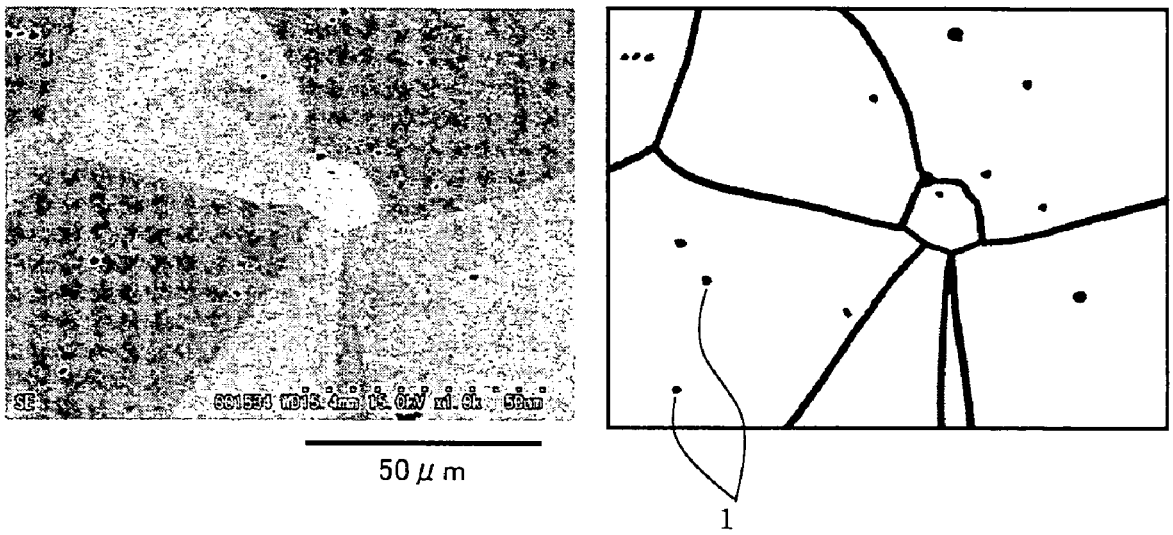
FIG. 1 shows a scanning electron micrograph of Alloy No. 3, according to the invention, that is heat treated at 800° C. for 400 hours and its explanatory schematic drawing.

An important feature of the present invention lies in a fact that it has improved structural stability after a long-time exposure at high temperature by improving an alloy disclosed in JP H11-229059-A2 which was proposed by one of the present applicants. In the alloy disclosed by JP H11-229059-A2, the total amount of Cr, Mo and W is regarded as being important for securing structural stability. However, when the alloy containing the total amount of Cr, Mo and W in the range specified in JP H11-229059-A2 contains less Ni, the alloy has insufficient structural stability at a high temperature, forms an embrittling phase such as a σ-phase or an α'-phase by being heated for a long time, and lowers its toughness. For this reason, Ni also needs to be adjusted into a particular range. Specifically, the alloy can acquire a stable structure at a high temperature and excellent high-temperature strength only when the amount of Ni is controlled together with the amount of Cr, Mo and W.

An element W has the effects of solution-strengthening an austenite matrix and increasing high-temperature fatigue strength and high-temperature creep strength, as well as Mo does. However, the element W has about twice as high specific gravity as Mo has, so that the element W needs to be added in twice an amount of Mo to give the alloy an equal effect to Mo. In addition, the twice amount of W addition causes the demerit of easily precipitating a LAVES phase of an embrittling phase, even though it provides an effect equal to Mo. Accordingly, only Mo is essentially added to an alloy in the present invention, which aims at a low cost and structural stability. An alloy according to the present invention, which makes the most of a solution-strengthening effect of Mo while keeping structural stability, has a further advantage of having high fatigue strength after having been used for a long time, because the solution-strengthening effect of Mo is stable, while the precipitation-strengthening effect of a γ'-phase is gradually decreasing due to coarsening and aggregation of a γ'-phase during being heated for a long time.

The reason of having specified each chemical composition in a heat resistant alloy for use as a material of an engine valve according to the present invention will be described below. In the description, the chemical composition will be indicated by mass % except in cases of particular description.

C: 0.01 to 0.15%

An element C is bonded with Ti and/or Nb to form MC carbide, and helps prevent crystal grains from coarsening and improve creep rupture ductility. When a C content is less than 0.01%, C does not show the sufficient effects which the MC carbide has. On the other hand, if the C content exceeds 0.15%, it causes the problem of lowering the ductility in grain boundaries at room temperature, due to decomposition of many MC carbides into $M_{23}C_6$ carbides during being heated for a long time, so that the C content has been specified into the range of 0.01 to 0.15%. A preferable range of C is 0.01 to 0.08%.

Si: 0.01 to 0.8%

In order to provide a sufficient deoxidizing effect, Si needs to be added in an amount of 0.01% or more, but the addition of Si exceeding 0.8% causes a problem of decreasing high-temperature strength, so that a Si content is specified to a range of 0.01 to 0.8%. A preferable range of Si is 0.01 to 0.6%.

Mn: 0.01 to 0.8%

An element Mn also needs to be added in an amount of 0.01% or more similarly to Si in order to provide a deoxidization effect, but the addition of Mn exceeding 0.8% causes a problem of decreasing high-temperature strength, so that the Mn content is specified to a range of 0.01 to 0.8%. A preferable range of Mn is 0.01 to 0.6%.

Cr: 14 to 17%

Cr is an indispensable element for imparting oxidation resistance to an alloy to be used at a high temperature, and an important element also having the role of solution-strengthening the alloy through dissolving in austenite. Though at least 14% Cr is necessary for securing oxidation resistance and heat resistance required of a material for an automotive engine valve, Cr exceeding 17% of the upper limit makes a structure unstable after a long-time exposure at high temperature, caused the formation of a harmful embrittling phase such as an α'-phase or a σ-phase rich in Cr, and lowers fatigue strength, creep rupture strength, and ductility at room temperature. The important feature of the present invention is an excellent structural stability after a long-time exposure at high temperature so that Cr content is limited to such a minimum value as to maintain oxidation resistance. Accordingly, the Cr content is specified to 14 to 17%. A preferable range of Cr is 14.5 to 16.5%. A further preferable range is 15 to 16.5%, and a more preferable range is 15.5 to 16.5%.

Mo: More than 3.0% but Equal to or Less than 5.0%

Mo has the effects of solution-strengthening an austenitic matrix and remarkably increasing high-temperature fatigue strength and high-temperature creep strength, and is one of the most important elements in an alloy according to the present invention. Mo in an amount of 3.0% or less does not sufficiently solution-strengthen the austenitic matrix, and can not make high-temperature strength reach a targeted value of the present invention. On the contrary, the excessive addition of such Mo as to exceed 5.0% impairs hot workability and causes the problem of precipitating a harmful phase such as an α'-phase and a σ-phase after a long-time exposure at high temperature as in the case of containing excessive Cr. Accordingly, the Mo content is specified to more than 3.0% but equal to or less than 5.0%. A preferable range is 3.3 to 4.8%. A more preferable upper limit of the Mo content is 4.6% or less, and further preferably is 4.0% or less. In addition, a more preferable lower limit of the Mo content is 3.5% or more.

Al: 1.6 to 2.5%

Al is an indispensable element for precipitating a stable γ'-phase and providing desired high-temperature strength, so that the alloy needs to contain at least 1.6% Al. But, an Al content exceeding 2.5% causes the problem of lowering hot workability, so that it is specified into 1.6 to 2.5%. A preferable range of Al is 1.6 to 2.1%, and a more preferable range is 1.6 to 1.9%.

Ti: 1.5 to 3.0% Ti is bonded with C to form MC carbides and refines austenitic crystal grains, is also bonded with Ni, like Al, Nb and Ta, to form a γ'-phase having the effect of increasing high-temperature strength, so that 1.5% or more Ti needs to be added. However, the addition of Ti exceeding 3.0% easily causes the transformation of the γ'-phase to an η-phase at a high temperature to lower high-temperature strength, and furthermore, the excessive addition of Ti causes the problem of lowering hot workability due to excessive increase of the γ'-phase. Accordingly, the composition range of Ti is specified into 1.5 to 3.0%. A preferable range of Ti is 1.5 to 2.5%. A more preferable of the Ti content is 2.3% or less, and a further preferred lower limit of the Ti content is 1.8% or more.

Nb or Nb+Ta of 0.5 to 2.0%

Each of Nb and Ta is bonded with C similarly to Ti, to form MC carbides and refines austenitic crystal grains, and has the effect of forming a γ'-phase to increase high-temperature strength. But it has the effect of further stabilizing the γ'-phase at a high temperature in comparison with Ti, to inhibit the high-temperature strength from lowering after a long-time exposure at high temperature. Accordingly, at least 0.5% or more of Nb alone, or at least 0.5% or more of Nb and Ta in total needs to be added, but the excessive addition of them exceeding 2.0% easily causes the transformation of the γ'-phase into a δ-phase at a high temperature to cause the problem of lowering high-temperature strength, so that the total amount of Nb and Ta to be added is specified to 0.5 to 2.0%. A preferable range of Nb and Ta to be added is 0.5 to 1.8%. A more preferable upper limit of the Nb+Ta content is 1.6% or less, and further preferably is 1.4% or less. In addition, a more preferred lower limit of the Nb+Ta content is 0.8% or more, and further preferably is 1.0% or more.

Ni: 50 to 60%

Ni is a very important element which stabilizes an austenitic matrix to enhance high-temperature strength, and is an element constituting a γ'-phase that contributes to precipitation strengthening. A Ni content in an amount of less than 50% causes an insufficient precipitation of a γ'-phase and cannot dissolve Mo of a solution-strengthening element in a sufficient amount for strengthening the alloy while keeping the structural stability, to cause the problem of lowering high-temperature strength. On the other hand, the Ni content exceeding 60% deteriorates hot workability, and besides, causes the problem of losing a merit as a low cost material. Accordingly, the Ni content is specified into a range of 50 to 60%. A preferable range of Ni is 50 to 58%. A more preferable upper limit of the Ni content is 56% or less. A more preferable lower limit of the Ni content is 52% or more, and further preferably is 54% or more.

B: 0.001 to 0.015%

An addition of an appropriate amount of B is effective in enhancing high-temperature strength and ductility, through a grain boundary-strengthening effect. The effect of the addition appears from an amount as low as 0.001%, but the amount exceeding 0.015% lowers the melting point in the B-segregated part to partly deteriorate high-temperature ductility to cause the problem of deteriorating hot workability, so that the B content is specified to 0.001 to 0.015%.

At Least One of 0.001 to 0.015% Mg and 0.001 to 0.015% Ca

Both Mg and Ca are strong deoxidizing/desulfurizing elements for enhancing the cleanliness of an alloy, and contribute to the improvement of ductility necessary when the alloy has been subjected to tensile deformation, creep stress and hot working at high temperature, so that at least one of them should be added in an appropriate amount. The effect of added Mg and Ca appears from an amount as low as 0.001%, but each amount exceeding 0.015% forms a compound with a low melting point to lower high-temperature ductility and consequently cause the problem of deteriorating hot workability, so that the content of Mg and Ca is each specified to 0.001 to 0.015%.

Balance Substantially Fe

The balance is Fe, but may include unavoidable impurities. In addition, the following elements can be contained in the range described below. P≦0.04%, S≦0.02%, O≦0.02%, N≦0.05%

In the present invention, in order to obtain high-temperature strength equal to or higher than NCF751 and structural stability at a high temperature, it is necessary not only to specify the content of individual element as described above, but also to specify the contents of Ni and Cr which are elements constituting austenite of the matrix of the alloy, and Mo of a solution-strengthening element, into the most suitable ranges satisfying a relational expression.

The structural stability is determined by the balance of Ni and Cr of the elements constituting austenite of the matrix with Mo of a solution-strengthening element. It is important for enhancing high-temperature strength to make the alloy contain Mo of a solution-strengthening element as much as possible while keeping the extent of a Ni content to 50 to 60 mass % and a Cr content 14 to 17 mass %, and keeping structural stability. Excellent high-temperature strength and high-temperature structural stability can be simultaneously achieved by specifying, by atom %, the value A defined by the expression: 0.293[Ni]−0.513[Cr]−1.814[Mo], to 2.0 to 5.8. When the value A is less than 2.0, a σ-phase or α'-phase of an embrittling phase precipitates after a long-time exposure at high temperature to degrade the toughness of the alloy material. On the other hand, when the value A exceeds 5.8, a solution-strengthening effect becomes insufficient, and high-temperature strength is lowered. A preferable range of the value A is 2.2 to 5.6. A further preferable range is 2.4 to 5.0, and the range of 2.4 to 4.0 is still further preferable.

In the present invention, a ratio of Al in a γ'-phase and the total amount of Al, Ti, Nb and Ta of elements forming a γ'-phase are specified as described below.

$$[Al]/([Al]+[Ti]+[Nb]+[Ta]) \quad \text{value B:}$$

$$[Al]+[Ti]+[Nb]+[Ta] \quad \text{value C:}$$

In the above expressions, brackets mean atomic %.

The value B represents the ratio of Al in the γ'-phase. When the ratio of Al is low, and the value B is less than 0.45, high-temperature strength is lowered due to the transformation of the γ'-phase to η-phase or δ-phase after a long-time exposure at high temperature; and on the contrary, when the ratio of Al is high and the value B exceeds 0.65, the lattice constant of the γ'-phase is decreased to degrade the effect of precipitation strengthening, and high-temperature strength as well as hot workability are lowered. Accordingly, the value B needs to be specified to 0.45 to 0.65. A preferable range of the value B is 0.5 to 0.6.

In addition, in order to obtain sufficient high-temperature strength, the value C needs to be 6.2 or more. However, when the value C exceeds 7.6, too much γ'-phase is formed to increase deformation resistance during hot working, which lowers hot workability and causes difficulty in manufacturing of engine valves. Accordingly, the value C is specified to 6.2 to 7.6. A more preferable range of the value C is 6.2 to 7.4. A further preferable range is 6.4 to 7.2, and a range of 6.4 to 7.0 is still further preferable.

In the present invention, in order to further improve structural stability after a long-time exposure at high temperature, the segregation of elements in an alloy was also studied.

An alloy according to the present invention contains Mo of a solution-strengthening element to such a limit as to barely keep structural stability, for the purpose of increasing high-temperature strength in the extent of a 50 to 60 mass % Ni content. If an alloy contains segregated parts of elements in the above state, the structure may become partially unstable. For this reason, the influence of the segregation of elements on structural stability was investigated, and as a result, it was found that Cr of an element constituting austenite has the largest effect. When the alloy contains the Cr-segregation, an embrittling phase such as a σ-phase and an α'-phase tends to be easily formed in a part containing a high concentration of Cr and to lower strength. Accordingly, the segregation of Cr was variously examined, and as a result, it was found that the structural stability of an alloy is secured by controlling the maximum and minimum values of Cr so as to satisfy the expression: (maximum value)/(minimum value)≦1.2, when Cr was line-analyzed with EPMA on one cross section of an alloy according to the present invention. A preferable ratio of (maximum value)/(minimum value) is 1.1 or less.

In a heat resistant alloy containing 50-60 mass % Ni, it is essential for increasing high-temperature strength as well as keeping toughness after a long-time exposure at high temperature to secure structural stability after a long-time exposure at high temperature. The segregation of Cr can be reduced by homogenizing, by heat-treatment at 1,150-1,220° C. for 10 hours, a steel ingot after having been melted or a steel ingot after having been remelted with the of VAR, ESR or the like. An alloy according to the present invention has a composition in the vicinity of a boundary zone of the region where the austenite of a matrix is stable, so that the alloy goes out of the stable zone of the austenite and easily forms an embrittling phase which lowers the toughness of the alloy, particularly when Cr is segregated. For this reason, an alloy according to the present invention is homogenized by heat treatment to reduce the segregation of Cr and improve structural stability after a long-time exposure at high temperature, so that the alloy can stably secure high toughness.

In addition, in recent years, the use-life of automobiles has been extended, and for this reason, higher durability than before is required for each component material. A heat resistant alloy for use as a material of automobile engine valves also needs to satisfy a Charpy impact value of 50 J/cm$^2$ or more at room temperature after having been heated at 800° C. for 400 hours, otherwise, may not satisfy the toughness required for valves after having been used for a long period of time. Accordingly, an alloy according to the present invention is specified as needed so as to have a 2 mm U-notch Charpy impact value of 50 J/cm$^2$ or higher at room temperature after having heated at 800° C. for 400 hours.

Furthermore, an alloy according to the present invention is specified so as not to substantially precipitate intermetallic compounds of an α'-phase, an η-phase and a δ-phase with the lengths of 3 μm or more, when the micro structure is observed after having been heated at 800° C. for 400 hours, and thereby the alloy can acquire further reliable toughness after a long-time exposure at high temperature. The intermetallic compounds of the σ-phase, the α'-phase, the η-phase and the δ-phase lower the toughness of an alloy. The alloy having no such intermetallic compounds substantially precipitated can have such a 2 mm U-notch Charpy impact value at room temperature after exposure at 800° C. for 400 hours as to satisfy 50 J/cm$^2$ or more and preferably 70 J/cm$^2$ or more.

When the intermetallic compounds of a σ-phase, an α'-phase, an η-phase and a δ-phase of 3 μm or longer precipitate in an alloy, the alloy may greatly deteriorate toughness. Here, an alloy substantially having no precipitation of intermetallic compounds of the σ-phase, the α'-phase, the η-phase and the δ-phase means the alloy having no such a size of intermetallic compounds in the structure as to be observed with a SEM at a magnification of thousand times. In addition, in order to further reliably acquire the toughness after a long-time exposure at high temperature, the intermetallic compounds with 2 μm or longer do not preferably precipitate, and the intermetallic compounds with 1 μm or longer further preferably do not precipitate.

EXAMPLES

Alloys according to the present invention and alloys of comparative examples were melted in a vacuum induction furnace into steel ingots of 10 kg, were homogenized at 1,180° C. for 20 hours and then forged into square bars with a side of 30 mm at a temperature of 1, 150° C. The chemical compositions of alloy Nos. 1 to 9 according to the present invention, a conventional alloy No. 21 and alloy Nos. 22 to 27 of comparative examples are shown in Table 1. Here, the conventional alloy No. 21 is an alloy equivalent to NCF751; the alloy Nos. 22, 23 and 27 of the comparative examples are those disclosed in JP H11-229059-A2; and particularly the alloy No. 27 of the comparative example is an alloy equivalent to an example No. 6 in JP H11-229059-A2. In addition, only the alloy No. 23 of the comparative example was not subjected to the above-described homogenizing heat treatment. Furthermore, in order to evaluate samples having shapes close to an actual valve material, a steel ingot of an alloy No. 9 according to the present invention was hot-forged at 1,150° C. into a round bar and was cold-drawn into a bar with the final diameter of 6 mm.

TABLE 1

| | Chemical Composition (mass %) | | | | | | | | | | | | | | In atomic % | | | |
|---|---|---|---|---|---|---|---|---|---|---|---|---|---|---|---|---|---|---|
| | | | | | | | | | | | | | | | Value | Value | Value | |
| No. | C | Si | Mn | Cr | Mo | Al | Ti | Nb | Ta | Ni | B | Mg | Ca | Fe | A | B | C | Remarks |
| 1 | 0.032 | 0.10 | 0.11 | 15.6 | 4.60 | 1.62 | 1.91 | 1.04 | — | 58.9 | 0.004 | 0.004 | — | bal. | 3.03 | 0.54 | 6.32 | Invention |
| 2 | 0.033 | 0.09 | 0.12 | 15.1 | 3.05 | 1.88 | 2.03 | 1.19 | — | 53.4 | 0.003 | 0.002 | — | bal. | 3.37 | 0.56 | 7.03 | Invention |
| 3 | 0.030 | 0.13 | 0.10 | 16.3 | 3.69 | 1.77 | 2.10 | 1.16 | — | 55.1 | 0.003 | 0.004 | — | bal. | 2.51 | 0.54 | 6.89 | Invention |
| 4 | 0.031 | 0.12 | 0.11 | 16.5 | 3.77 | 1.65 | 1.98 | 1.10 | — | 54.5 | 0.005 | 0.005 | — | bal. | 2.15 | 0.53 | 6.47 | Invention |
| 5 | 0.033 | 0.10 | 0.14 | 15.9 | 3.62 | 1.86 | 2.21 | 1.23 | — | 55.5 | 0.005 | 0.004 | — | bal. | 2.92 | 0.54 | 7.24 | Invention |
| 6 | 0.024 | 0.15 | 0.09 | 15.3 | 3.72 | 1.69 | 2.07 | 1.11 | — | 58.3 | 0.004 | — | 0.006 | bal. | 3.95 | 0.53 | 6.68 | Invention |
| 7 | 0.029 | 0.12 | 0.09 | 15.5 | 4.56 | 1.64 | 2.16 | 0.52 | 1.01 | 58.6 | 0.006 | 0.003 | — | bal. | 3.06 | 0.52 | 6.68 | Invention |
| 8 | 0.052 | 0.15 | 0.11 | 16.5 | 3.12 | 1.68 | 2.14 | 1.15 | — | 54.7 | 0.004 | 0.003 | 0.003 | bal. | 2.89 | 0.52 | 6.72 | Invention |
| 9 | 0.031 | 0.14 | 0.10 | 16.1 | 3.71 | 1.78 | 2.10 | 1.18 | — | 55.3 | 0.004 | 0.004 | — | bal. | 2.66 | 0.54 | 6.92 | Invention |
| 21 | 0.055 | 0.06 | 0.03 | 15.6 | — | 1.21 | 2.32 | 1.01 | — | bal. | 0.005 | 0.004 | — | 7.11 | | | | Conventional alloy |
| 22 | 0.032 | 0.12 | 0.13 | 17.5 | 3.22 | 1.84 | 2.38 | 0.64 | — | 51.8 | 0.005 | 0.003 | — | bal. | 1.43 | 0.55 | 7.00 | Conventional alloy |
| 23 | 0.038 | 0.14 | 0.08 | 17.3 | 3.75 | 1.81 | 2.15 | 1.22 | — | 55.2 | 0.003 | 0.003 | — | bal. | 1.91 | 0.54 | 7.05 | Conventional alloy |

TABLE 1-continued

| | Chemical Composition (mass %) | | | | | | | | | | | | | | In atomic % | | | |
|---|---|---|---|---|---|---|---|---|---|---|---|---|---|---|---|---|---|---|
| | | | | | | | | | | | | | | | Value | Value | Value | |
| No. | C | Si | Mn | Cr | Mo | Al | Ti | Nb | Ta | Ni | B | Mg | Ca | Fe | A | B | C | Remarks |
| 24 | 0.035 | 0.09 | 0.12 | 16.3 | 3.69 | 2.48 | 1.48 | 0.52 | — | 55.4 | 0.004 | 0.005 | — | bal. | 2.57 | 0.72 | 7.19 | Conventional alloy |
| 25 | 0.031 | 0.15 | 0.10 | 16.2 | 3.66 | 1.36 | 2.75 | 1.39 | — | 55.0 | 0.003 | 0.004 | — | bal. | 2.58 | 0.41 | 6.96 | Conventional alloy |
| 26 | 0.035 | 0.10 | 0.11 | 16.4 | 3.93 | 1.44 | 1.73 | 0.96 | — | 58.1 | 0.006 | 0.008 | — | bal. | 3.06 | 0.53 | 5.67 | Conventional alloy |
| 27 | 0.030 | 0.13 | 0.11 | 17.7 | 2.95 | 1.62 | 2.71 | 0.58 | — | 51.5 | 0.005 | 0.002 | — | bal. | 1.48 | 0.49 | 6.89 | Conventional alloy |

Notes:
Value A = 0.293[Ni] − 0.513[Cr] − 1.814[Mo]
Value B = [Al]/([Al] + [Ti] + [Nb] + [Ta])
Value C = [Al] + [Ti] + [Nb] + [Ta]
Bracket shows atomic % of each element.
"—" means not added.

In order to evaluate the segregated state of Cr, samples were cut out from the forged material and the bar so that the longitudinal sections could be measurement planes, and were subjected to a line analysis for analyzing Cr by using an EPMA having a beam with the diameter of 7.5 μm, on the line of 3 mm long transversely to a longitudinal direction. The maximum and minimum values were read, and the value of (maximum value)/(minimum value) was calculated, which indicates the degree of segregation. In addition, a forged material and a bar were subjected to solution treatment consisting of heating at 1,050° C. for 30 minutes and then water-cooling, and then to aging treatment consisting of heating at 750° C. for 4 hours and then air-cooling. From the forged material after the heat treatment described above, a test piece was cut out so as to have the shape of a round bar with the diameter of 6.35 mm in a parallel part and the distance between gauge marks of 25.4 mm, and was subjected to a tensile test at 800° C. according to an ASTM method.

In addition, from the material after having been heat-treated with the above method, a test piece was cut out so as to have the shape of a round bar with the diameter of 8 mm in a parallel part, and was subjected to a rotary bending fatigue test at the testing temperature of 800° C. and at the rotation speed of 3,600 rpm according to JIS Z2274, and the fatigue strength at $1\times10^7$ cycles was determined. In addition, the above aged material was heated at 800° C. for 400 hours, a test piece with a 2 mm U-notch according to JIS No. 3 was cut out from the material, was subjected to a Charpy impact test at room temperature according to JIS Z2242.

In addition, in order to examine structural stability of each alloy at a high temperature, the micro structure in the area of 150 $mm^2$ wide in the samples after having been heated at 800° C. for 400 hours was observed with a SEM at a magnification of 1000 times. The results are shown in Table 2. Here, an alloy No. 9 according to the present invention was a bar material with the diameter of 6 mm and it was difficult to work a test piece from the bar, so that the sample was subjected only to measurement for segregated Cr, a tensile test with the use of a downsized test piece and micro structure observation.

TABLE 2

| | | Mechanical Properties at 800° C. | | | Rotation Bending | 2 mm U notch | Precipitants | Existence of |
|---|---|---|---|---|---|---|---|---|
| No. | Max Content/ Min Content of Cr analyzed by EPMA | 0.2% Proof Stress (MPa) | Tensile Strength (MPa) | Elongation (%) | Fatigue Strength (MPa) at $1\times10^7$ cycles at 800° C. | Charpy Impact Strength ($J/cm^2$) after 800° C. × 400 hours | observed by SEM microscopy after 800° C. × 400 hours | Intermetallic Compounds of 3 μm or longer after 800° C. × 400 hours |
| 1 | 1.09 | 625.3 | 710.2 | 7.7 | 329 | 96.2 | γ, γ', MC, $M_{23}C_6$ | Not found |
| 2 | 1.12 | 641.7 | 711.3 | 7.6 | 332 | 90.9 | γ, γ', MC, $M_{23}C_6$ | Not found |
| 3 | 1.15 | 665.7 | 738.6 | 7.2 | 338 | 94.5 | γ, γ', MC, $M_{23}C_6$ | Not found |
| 4 | 1.10 | 648.3 | 714.8 | 8.6 | 315 | 104.7 | γ, γ', MC, $M_{23}C_6$ | Not found |
| 5 | 1.16 | 671.1 | 743.5 | 6.1 | 339 | 91.7 | γ, γ', MC, $M_{23}C_6$ | Not found |
| 6 | 1.13 | 667.8 | 729.1 | 6.5 | 334 | 98.4 | γ, γ', MC, $M_{23}C_6$ | Not found |
| 7 | 1.09 | 627.2 | 708.4 | 6.9 | 314 | 102.8 | γ, γ', MC, $M_{23}C_6$ | Not found |
| 8 | 1.11 | 635.4 | 712.7 | 7.1 | 318 | 96.4 | γ, γ', MC, $M_{23}C_6$ | Not found |
| 9 | 1.06 | 674.3 | 745.1 | 9.1 | | | γ, γ', MC, $M_{23}C_6$ | Not found |
| 21 | 1.11 | 615.1 | 699.3 | 15.6 | 292 | 79.4 | γ, γ', MC, $M_{23}C_6$ | Not found |
| 22 | 1.14 | 619.3 | 684.4 | 5.6 | 310 | 20.9 | γ, γ', MC, $M_{23}C_6$, σ | Found |
| 23 | 1.41 | 627.2 | 693.6 | 6.1 | 319 | 32.6 | γ, γ', MC, $M_{23}C_6$, σ | Found |
| 24 | 1.16 | 562.1 | 611.3 | 6.4 | 278 | 92.4 | γ, γ', MC, $M_{23}C_6$ | Not found |
| 25 | 1.18 | 538.6 | 574.3 | 4.1 | 246 | 60.2 | γ, γ', MC, $M_{23}C_6$, η | Found |
| 26 | 1.15 | 495.7 | 541.5 | 9.7 | 229 | 115.3 | γ, γ', MC, $M_{23}C_6$ | Not found |
| 27 | 1.13 | 640.5 | 702.4 | 5.9 | 294 | 24.8 | γ, γ', MC, $M_{23}C_6$, σ | Found |

Figure 2:
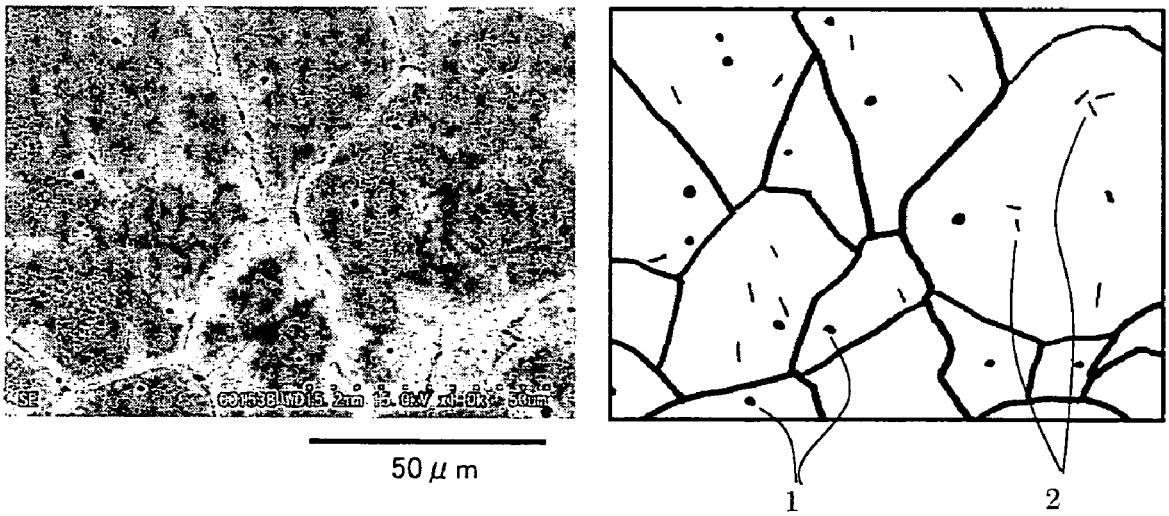
FIG. 2 shows a scanning electron micrograph of Comparative Alloy No. 22 heat treated at 800° C. for 400 hours and its explanatory schematic drawing.

An alloy No. 3 according to the present invention and an alloy No. 22 of a comparative example were heated at 800° C. for 400 hours and were corroded with a liquid prepared by mixing hydrochloric acid, nitric acid and glycerin into the volume ratio of 3:1:1. Their electron microscopic structures were observed by a SEM at a magnification of 1000 times. The photographs are shown respectively in FIG. 1 and FIG. 2, together with the schematic drawings. In an alloy No. 3 according to the present invention, only MC carbide 1 was observed in the austenite of the matrix, but in an alloy No. 22 of a comparative example, which has low structural stability after a long-time exposure at high temperature, not only the MC carbide 1 but also the σ-phase 2 of an embrittling phase is precipitated.

From Table 2, it is clear that alloy Nos. 1 to 8 according to the present invention have more excellent mechanical properties and fatigue strength at 800° C. than a conventional alloy No. 21 equivalent to an NCF751 alloy has. In addition, alloys according to the present invention have less segregation of Cr, a high Charpy impact value after having been heated at 800° C. for 400 hours, no confirmable intermetallic compound of a σ-phase, an α'-phase, an η-phase and a δ-phase of 3 μm or longer in a structure observed with a SEM at a magnification of 1000 times, so that Table 2 shows that they have also very high structural stability at a high temperature. Furthermore, with the SEM at the high magnification of even 4,000 times, the intermetallic compounds with the lengths exceeding 1 μm were not observed in the structures of the alloys according to the present invention. An alloy No. 9 according to the present invention of the bar sample with the diameter of 6 mm has also excellent mechanical properties at 800° C. and contains very little segregated Cr, similarly to the alloy Nos. 1 to 8.

An alloy No. 22 of a comparative example, which has been disclosed in JP H11-229059-A2, has high mechanical properties and fatigue strength at 800° C., but contains much Cr and has low structural stability at a high temperature, so that the σ-phase of an embrittling phase precipitates after having been heated at 800° C. for 400 hours to embrittle the alloy and causes a low Charpy impact value. Similarly, the alloy No. 23 of a comparative example has low structural stability at a high temperature due to the segregation of Cr, and has a low Charpy impact value after having been heated at 800° C. for 400 hours. In addition, all of alloy Nos. 24, 25 and 26 of a comparative example have lower mechanical properties and fatigue strength at 800° C. than alloys according to the present invention have, respectively due to a high ratio of Al in a γ'-phase, to transformation of the γ'-phase to an η-phase of an embrittling phase after a long-time exposure at high temperature, because of having the low ratio of Al in the γ'-phase, and to a too small amount of the γ'-phase to contribute to the precipitation strengthening of the alloy.

An alloy No. 27 of a comparative example equivalent to an alloy of an example in JP H11-229059-A2 contains a small amount of Mo, so that it has low fatigue strength at $1\times10^7$ cycles, and has a low value A, so that it has low structural stability at a high temperature, precipitates a σ-phase of an embrittling phase after having been heated at 800° C. for 400 hours to embrittle itself, and causes a low Charpy impact value. Specifically, only alloys according to the present invention, which contain an amount of Mo sufficient for strengthening a material and satisfy the condition for a value A showing structural stability at a high temperature, have high fatigue strength at $1\times10^7$ cycles together with high toughness after a long-time exposure at high temperature.

As described above, an alloy according to the present invention is found to be a heat resistant alloy which has higher high-temperature strength than NCF751, has excellent structural stability at a high temperature, shows high toughness after a long-time exposure at high temperature, is inexpensive, economical, resource-saving and suitable for use as a material of engine valves.

A heat resistant alloy for use as a material of engine valves according to the present invention has high-temperature strength and excellent toughness after a long-time exposure at high temperature, which have not been achieved by a conventional heat resistant alloy, has a resource-saving property, a cost-reducing property and an economical advantage, so that the alloy can realize a higher efficiency of an engine, save resources and lower the cost of the valve material, when used as an engine valve material requiring high strength.

What is claimed is:

1. A heat resistant alloy for use as material of engine valve consisting essentially of, in mass percent, C of 0.01 to 0.15%, Si of 0.01 to 0.8%, Mn of 0.01 to 0.8%, Cr of 14 to 17%, Mo of more than 3.0% but equal to or less than 5.0%, Al of 1.6 to 2.5%, Ti of 1.5 to 3.0%, Nb or Nb+Ta of 0.5 to 2.0%, Ni of 50 to 60%, B of 0.001 to 0.015%, at least one of Mg of 0.001 to 0.015% and Ca of 0.001 to 0.015%, and the balance being Fe, wherein value A defined by 0.293[Ni]−0.513[Cr]−1.814[Mo] is 2.0 to 5.8, value B defined by [Al]/([Al]+[Ti]+[Nb]+[Ta]) is 0.45 to 0.65, and value C defined by [Al]+[Ti]+[Nb]+[Ta] is 6.2 to 7.6, wherein brackets mean atomic % of each element in the heat resistant alloy, and wherein a ratio of maximum Cr content to minimum Cr content is equal to or less than 1.2 when a line analysis of Cr segregation is performed on a cross section of the heat resistant alloy by an EPMA.

2. The heat resistant alloy as set forth in claim 1, wherein Mo is 3.5 to 4.0%, value A is 2.4 to 4.0, value B is 0.5 to 0.6, and value C is 6.4 to 7.0.

3. The heat resistant alloy as set forth in claim 2, wherein intermetallic compound grains of σ-phase, α'-phase, η-phase or δ-phase of equal to or longer than 3 μm do not precipitate in a microscopic structure of the heat resistant alloy after heated at 800° C. for 400 hours.

4. The heat resistant alloy as set forth in claim 3, wherein 2 mm U notch Charpy impact strength is equal to or more than 50 J/cm$^2$ at room temperature after heated at 800° C. for 400 hours.

5. The heat resistant alloy as set forth in claim 1, wherein intermetallic compound grains of σ-phase, α'-phase, η-phase or δ-phase of equal to or longer than 3 μm do not precipitate in a microscopic structure of the heat resistant alloy after heated at 800° C. for 400 hours.

6. The heat resistant alloy as set forth in claim 5, wherein 2 mm U notch Charpy impact strength is equal to or more than 50 J/cm$^2$ at room temperature after heated at 800° C. for 400 hours.

* * * * *